United States Patent [19]

Gow

[11] Patent Number: 5,025,349

[45] Date of Patent: Jun. 18, 1991

[54] EMERGENCY LIGHTING FIXTURE

[76] Inventor: Thomas W. Gow, 1039 109th Ave. N.W., Coon Rapids, Minn.

[21] Appl. No.: 389,629

[22] Filed: Aug. 4, 1989

Related U.S. Application Data

[63] Continuation of Ser. No. 241,353, Sep. 8, 1988, abandoned, which is a continuation of Ser. No. 159,274, Feb. 23, 1988, abandoned, which is a continuation of Ser. No. 75,512, Jul. 20, 1987, abandoned.

[51] Int. Cl.[5] ..... F21V 19/04

[52] U.S. Cl. ..... 362/20; 362/147; 362/157; 362/197; 362/269; 362/271; 362/272; 362/276; 362/285; 362/286; 362/386

[58] Field of Search ..... 362/20, 256, 145, 147, 362/148, 150, 157, 183, 197, 198, 257, 269, 271, 272, 276, 285, 286, 364, 386, 428, 458

[56] References Cited

U.S. PATENT DOCUMENTS

| | | | |
|---|---|---|---|
| 4,461,974 | 7/1984 | Chiu | 362/20 |
| 4,651,258 | 3/1987 | Davis et al. | 362/386 |
| 4,682,078 | 7/1987 | Pascalide | 362/20 |
| 4,708,223 | 11/1987 | Orndorff et al. | 362/256 |
| 4,727,291 | 2/1988 | Bavaro | 362/20 |
| 4,802,065 | 1/1989 | Minter et al. | 362/20 |

*Primary Examiner*—Ira S. Lazarus
*Assistant Examiner*—Sue Hagarman
*Attorney, Agent, or Firm*—Lawrence M. Nawrocki

[57] ABSTRACT

An emergency lighting system having a motor drive assembly (34) for the automatic lowering of a battery-powered emergency lamp (12), when normal power to a primary lighting system is lost, from a concealed position behind a ceiling (11), and returning the lamp (12) to its original position when normal power is restored. Included in the assembly (34) are gears including a motor driven gear (36) and a crank arm driving gear (38). The presence of a normal electric current to the primary lighting system powers the motor drive assembly (34) to return and maintain the emergency lighting system in its concealed position. Interruption of normal electric power automatically results in driving of the emergency power system from its concealed position to an extended position for use, as a result of crank driving gear (38) being rotated in a direction opposite that in which it is rotated for return of the emergency system to the normal concealed position. Resumption of normal electric current returns the emergency lighting system to its concealed position.

5 Claims, 3 Drawing Sheets

EMERGENCY LIGHTING FIXTURE

This is a continuation of copending application Ser. No. 241,353 filed on Sept. 8, 1988, now abandoned, which is a continuation of application Ser. No. 159,274 filed on Feb. 23, 1988, now abandoned, which is a continuation of application Ser. No. 075,512, filed on July 20, 1987, now abandoned.

TECHNICAL FIELD

The present invention is generally related to the field of interior lighting. More narrowly, the invention relates to emergency lighting systems. Specifically, however, this invention is directed to an emergency lighting system that is mounted concealed from view above a ceiling, and is lowered only when a need for emergency lighting exists.

BACKGROUND OF THE INVENTION

Various types of emergency lighting systems are known in the prior art. Such systems are, invariably, mandated by governmental codes, and such codes define requirements with which the emergency lighting systems must comply.

The majority of these systems utilize battery-powered light fixtures. Such fixtures generally include a wall-mounted light attached to a battery pack.

One problem with these wall-mounted fixtures is their vulnerability to vandalism. Because of their general exposure, such fixtures are vulnerable to breakage of, or tampering with, the light itself, with possible resultant battery pack disconnecting or draining of the stored power. The result of either would be an unanticipated absence of emergency lighting during an outage of normal power.

In an attempt to offset the vulnerability to vandalism, some prior art emergency lighting systems utilize heavy plastic material to protect the lamp. Additionally, one such prior art system, that illustrated in U.S. Pat. No. 4,071,749 (Ballogh), employs a magnetically operated test switch device in order to protectably seal off the battery and its connection.

Other prior art structures utilize light fixtures that are mounted on existing light fixtures. Some include means for concealed attachment to an existing light fixture (for example, attachment to a fluorescent light fixture).

These prior art structures employ circuitry for implementing battery power when the primary lighting system (that is, the system normally employed to illuminate a room) powered by normal electric current fails. Some prior art structures convert the direct current of a battery into an alternating current for use by conventional lamps. While these features reduce their vulnerability to vandalism, they do, however, increase the complexity of the structures and, therefore, increase their potential for malfunctioning.

Additionally, the appearance of many light and battery pack devices as know in the prior art is not aesthetically pleasing. When thousands of dollars have been spent to establish a pleasing decor in an office, lobby, etc., the appearance of such a battery pack can be glaringly out of place.

Finally, devices known in the art tend to inadequately illuminate when activated. This is so, since their lamps are, typically, uni-directional and throw light only along an axis close to, and generally parallel to, the wall to which the device is mounted. Additionally, as previously indicated, some in-place systems employ lamps of the primary lighting system as emergency lighting. Only a portion of the total lamps in the primary system are, however, utilized when emergency lighting becomes necessary. This is so for a number of reasons. The end result with such systems is that lighting distribution is reduced, and the uniformity of distribution is destroyed.

It is to these problems of the prior art that the invention of the present application is directed. It is an aesthetically-pleasing, easy-to-install, vandal-resistant emergency lighting system utilizing a light fixture and battery pack assembly in combination with unique storage, actuation, and energization means.

SUMMARY OF THE INVENTION

The present invention is an emergency lighting fixture which becomes actuated to provide temporary lighting to a room when operation of a primary lighting system for the room becomes interrupted. The emergency lighting fixture includes a panel and lamp, mounted above the panel, which is aimed to illuminate the room. The panel is mounted in a celing of the room for movement between two positions. The normal position of the panel is one wherein the panel is retracted so that the lamp is hidden within the ceiling. The other position of the panel is an extended position wherein the lamp is exposed to illuminate the room. Means are provided to maintain the panel in the retracted position when power to the primary lighting system is uninterrupted. Means are also provided to move the panel to the extended position when power to the primary lighting system becomes interrupted. Finally, the fixture includes means, when the panel is in its extended position, for energizing the lamp.

In a preferred embodiment, the lamp is carried by the panel, and the panel is provided with a hinge along a first edge thereof by which the panel is pivotable at a plane defined by the ceiling. When such a structure is employed, the retracted position of the panel can be one wherein it is coplanar with the ceiling. The extended position of the panel would be one wherein the panel is pivoted, about the hinge, downwardly from the retracted position.

In the preferred embodiment, the panel carries a platen which intersects the panel along a second edge thereof, opposite the hinged edge. It is envisioned that the platen would intersect the panel generally perpendicularly. In this embodiment, the lamp projects from the platen generally perpendicularly thereto.

As will be able to be seen then, in view of this disclosure, when the panel is in its normal, retracted position, the platen-mounted lamp of the preferred embodiment would be recessed above the ceiling. When the panel would be moved to its extended position by pivoting it about the hinged edge, the lamp would be exposed and actuated so that light would be projected about the room at an angle slightly downwardly from the horizontal.

The preferred construction of the invention envisions employment of a crank arm which cooperates with the panel and the platen carried thereby to effect maintenance of the panel and its associated platen in the normal, retracted position when power to the primary lighting system is uninterrupted, and to urge the panel downwardly on its hinge when power to the primary lighting system becomes interrupted. The crank arm includes a shaft which has a main portion and a distal portion. the main portion has, mounted thereon, a gear, and the distal portion is spaced radially from an axis of elongation of the main portion.

The crank arm shaft is disposed for movement so that the main portion rotates about its axis of elongation. Rotation is between a first position wherein the distal portion is angled, to some degree, away from, and upwardly, relative to a directly downwardly extending orientation, and a second position wherein the distal portion is angularly spaced downwardly from the first position. In either position, however, the distal portion of the crank arm shaft is received in a generally horizontally extending slot formed in the platen.

The shaft is, in turn, geared to a motor by the gear carried by the main portion of the shaft and another gear of a motor drive assembly. The motor drive assembly functions, first, when power to the primary lighting system is operational, to rotate the crank arm shaft so that the distal portion of the shaft becomes angled farther away from a downwardly extending orientation and rides along the slot in the platen to effect urging of the panel to its retracted position. The assembly also functions, when power to the primary lighting system is interrupted, to rotationally drive the crank arm shaft so that the distal portion thereof becomes angularly spaced downward from the first position.

Limit switches can be employed to ascertain when the panel has achieved its fully retracted and lowered positions. When the panel becomes disposed in either position, the motor drive assembly will become deactivated so that further rotation of the crank arm shaft is not effected. The gears, however, remain meshed to maintain the panel in the retracted position.

A crank arm can be employed, in the preferred embodiment, wherein shafts extend on both sides of the gear carried by the crank arm. In such an embodiment, dual lighting fixtures can be operated by the same crank arm. Each end of the crank arm would function as a separate shaft, each shaft having its own distal portion. The twin panels operated by the common crank arm could be hinged along abutting edges, and the distal portions of corresponding shafts would be radially spaced in the same direction. Consequently, both corresponding panels would be able to be either retracted or extended concurrently.

The present invention is thus an improved emergency lighting fixture. More specific features and advantages obtained in view of those features will become apparent with reference to the DETAILED DESCRIPTION OF THE INVENTION, appended claims and accompanying drawing figures.

DETAILED DESCRIPTION OF THE INVENTION

Figure 1:
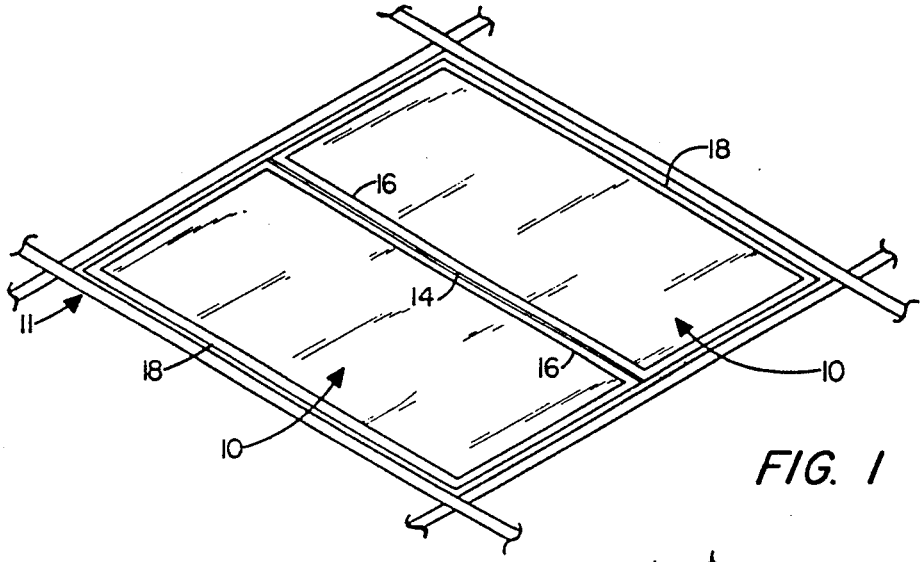
FIG. 1 is a perspective view of a pair of emergency lighting fixture panels, in accordance with the present invention, with the panels in their retracted positions.

Referring now to the drawings, wherein like reference numerals represent like elements throughout the several views, there is illustrated, in FIG. 1, a pair of ceiling tile panels 10 which can be employed in the present invention. The panels 10 which are utilized would, typically, conform to the construction of the ceiling and can take the form of acoustical tile, gypsum board, wooden slats, etc. In the retracted position of the panels 10, lamps 12 of th emergency lighting system fixture of the present invention are completely concealed from view.

Figure 2:
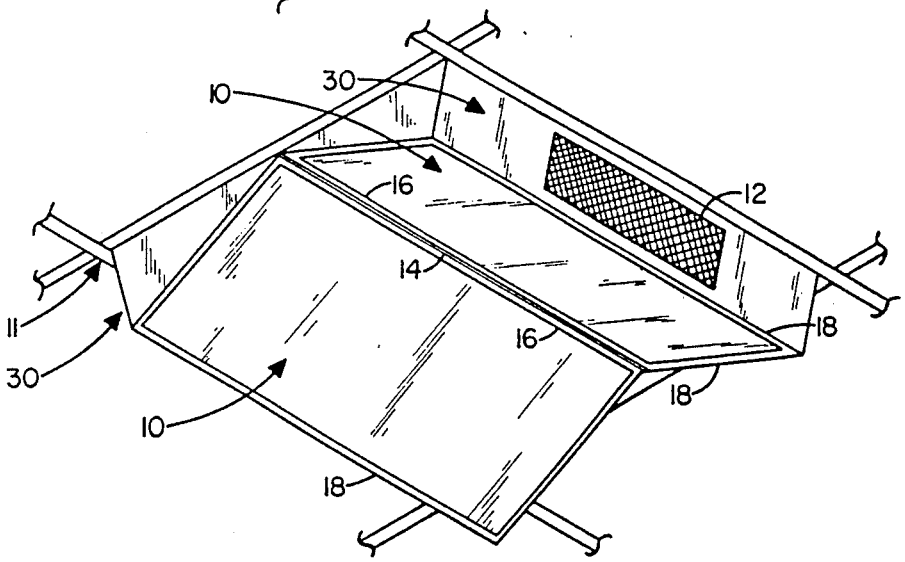
FIG. 2 is a view similar to FIG. 1, but with the panels in their extended positions.

FIG. 2 illustrates the panels 10 of the invention in their second positions lowered below the normal level of the ceiling 11 with the battery-powered lamps, indicated generally as 12, exposed for use. Light emanating from lamps 12 is directed downwardly at an angle from the ceiling to effect maximum illumination of the room when the emergency lighting fixture of the present invention is actuated.

Illustrated in FIG. 2 is the use of two panels 10 opening about the hinge 14. The hinged edge 16 of each of the two panels 10 remains at the same level as a plane defined by the ceiling. The edges 18 opposite the hinge 14, however, are allowed to drop to expose the battery-powered lamps 12 of the emergency power system. In the preferred embodiment, two such lamps would be associated with a corresponding pair of ceiling panels.

Figure 3:
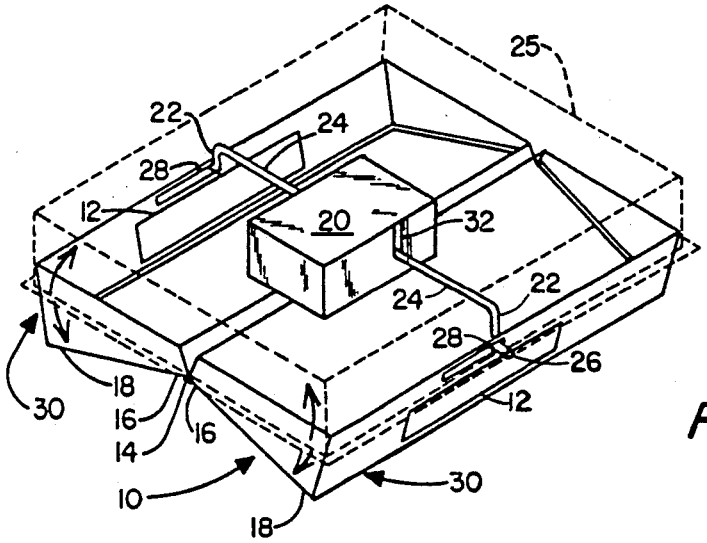
FIG. 3 is a perspective view illustrating structure employed for effecting movement of the panels between the retracted and extended positions.

FIG. 3 is a top perspective view of the emergency power system showing a motor drive assembly housing 20. Extending from each of two sides of the motor drive assembly housing 20 is a crank arm 22 defining shafts 24.

The device of the invention is shown in its lowered position in FIG. 3 with the panels 10 pivoted to their downward positions. Shown in phantom in FIG. 3 are the limits 25 of a cavity in which the panels 10 are recessed above the level of ceiling 11 when panels 10 are pivoted to upward positions.

The distal end portions 26 of the pair of shafts 24 are shown slideably received within corresponding slots 28 in platens 30 which are disposed generally perpendicularly to panels 10. The shafts 24 extend from apertures 32 withing the motor drive assembly housing 20.

Figure 4:
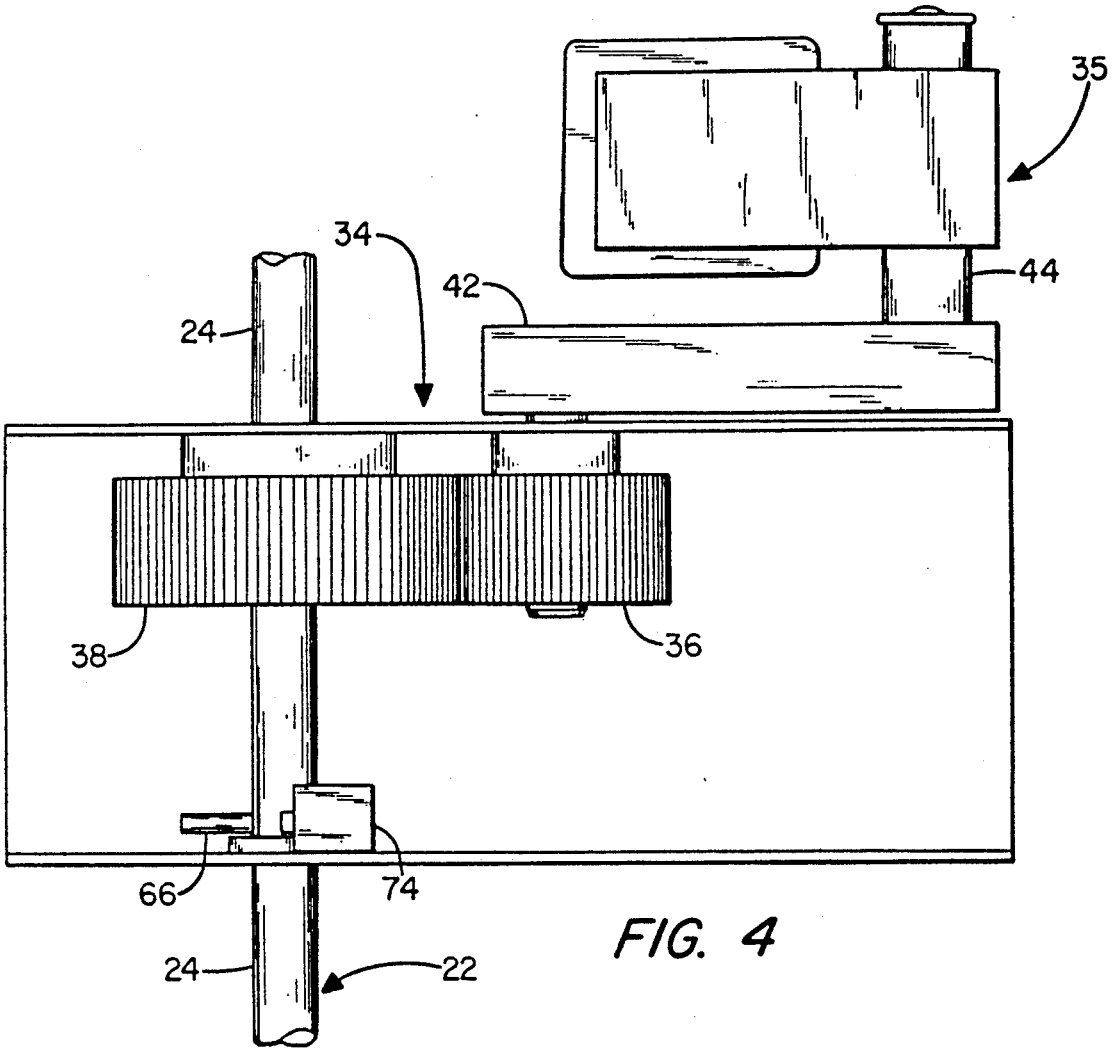
FIG. 4 is a top plan view of the motor drive assembly in accordance with the present invention.
Figure 5:
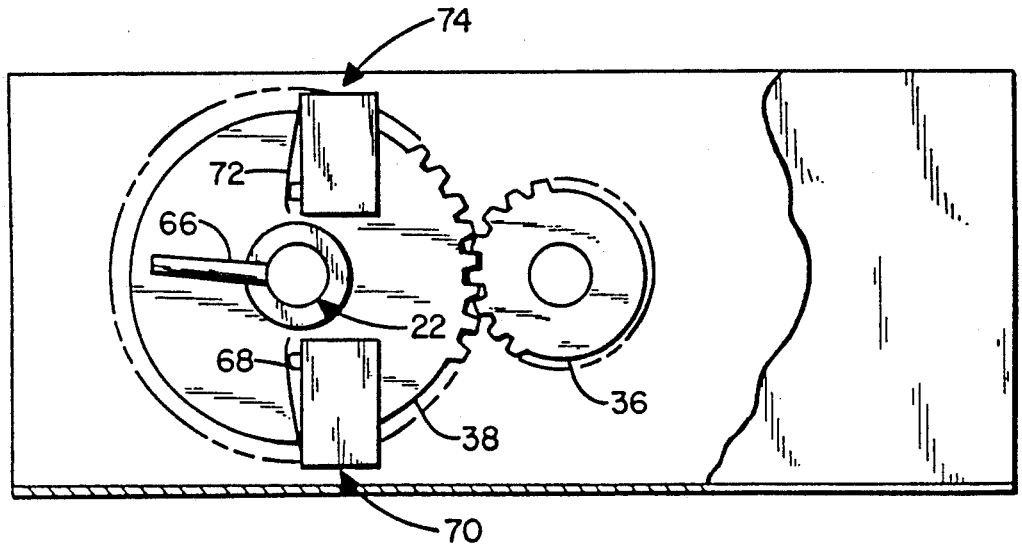
FIG. 5 is a side elevational view of the motor drive assembly of FIG. 4.

FIG. 4 is a top plan view of the motor drive assembly 34. A motor, illustrated generally at 35, drives an arrangement of gears 36, 38 transferring rotative motion from the motor 35 to crank arm 22. Gears 36, 38, therefore, rotate shafts 24. Included in the arrangement of gears are a motor driven gear 36 and a crank arm driving gear 38. Both of these gears include teeth 40, which extend continuously around their respective gear.

The motor driven gear 36 has transmitted thereto turning motion from the motor 35 through a transmission assembly (not shown) enclosed by shield 42. Rotative motion of a motor stub shaft 44 imparted to driven gear 36 through the transmission assembly is, in turn, transmitted to the crank arm driving gear 38.

Figure 6:
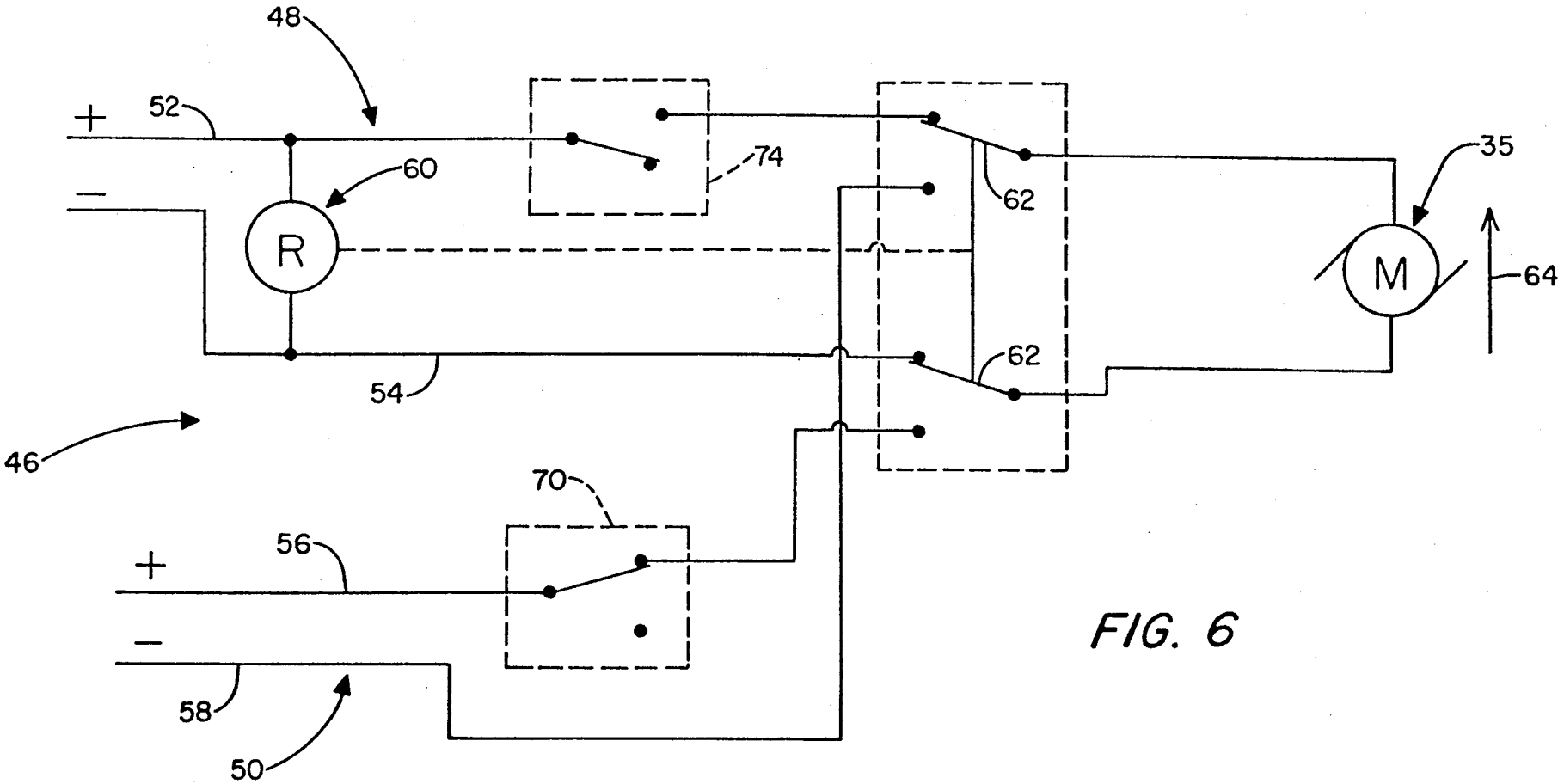
FIG. 6 is a schematic diagram illustrating the components employed for operating the motor drive assembly, in the positions they occupy when power to a primary lighting system is uninterrupted.

FIG. 6 illustrates a circuit 46 for controlling actuation of the motor 35 of the drive assembly 34. A first subcircuit 48 effects actuation of the motor 35 when current to the primary lighting system is uninterrupted, the primary lighting system current providing the power to drive the motor 35. A second subcircuit 50 effects actuation of the motor 35 when power to the primary lighting system becomes interrupted, a battery (not shown) which provides power to the emergency lamps 12 providing the power to drive the motor 35. It should be borne in mind that actuation of the motor 35 effects lowering and raising of the emergency lighting system.

The first subcircuit 48 includes a positive branch 52 and a negative branch 54. Similarly, the second subcircuit 50 also includes positive and negative branches 56, 58. The branches of both subcircuits are connectable to the motor 35, alternatively, in a manner as will be described hereinafter.

When the branches of one subcircuit are connected to the motor 35, however, they cause current to flow through the motor 35 in a direction opposite that in which current flows when the branches of the other subcircuit are connected. Consequently, actuation of the motor 35 by one subcircuit will cause the motor's stub shaft 44 to rotate in a direction opposite that in which it rotates when the motor 35 is actuated by the other subcircuit.

Current flow through, and actuation of, the primary lighting system is monitored by a double-pole, double-throw, electrically-held relay 60. When power is uninterrupted, the poles 62 of the relay 60 are maintained in the positions illustrated in FIG. 6 completing the first subcircuit 48. When normal power is interrupted, the relay 60 is de-energized. The poles 62 of the relay 60 are, thereby, thrown to their alternate positions to complete the second subcircuit 50. With current flowing through the second subcircuit 50 in a direction indicated by arrow 64, the motor 35 will effect lowering of the emergency lighting system by battery power.

Simultaneously, an electrically-held relay (not shown) effects actuation of the lamps 12 so that illumination can occur. Illumination of the lamps 12 is accomplished in a fashion as known in emergency lighting systems currently available.

As rotation of the motor 35 effects lowering of the emergency lighting system to an intended drop angle, a tab 66 carried by the crank arm 22 engages a contact 68 of a normally closed micro-switch 70 to open the circuit 50 so that the motor 35 becomes deactivated.

The panel 10 can be held in this position because of the high gear ratio of the gears 36, 38. Alternatively, or in conjunction with the positive holding provided by the high gear ratio of the gears 36, 38, the distal end portions 26 of the crank arm shafts 24 can engage ends of the slots 28 in which they ride to further preclude lowering.

When normal power is restored, the relay 60 is re-energized, and the poles 62 of the relay 60 are returned to their positions as illustrated in FIG. 6. The tab 66 carried by the crank arm 22, when the emergency lighting system is lowered, disengages from a contact 72 of a micro-switch 74 in the first subcircuit 48. This micro-switch is also normally closed, and disengagement effects closure thereof. Re-energization of the relay 60 in response to the restoration of normal power will, therefore, complete the first subcircuit 48.

In consequence, the motor 35 will be driven in a direction opposite that in which it was driven to lower the panels 10, and the panels 10 will be raised to their normal positions flush with the ceiling 11. Once the panels 10 achieve such positions, the tab 66 carried by the crank arm 22 will, again, engage the contact 72 of the micro-switch 74 in the first subcircuit 48 to open that micro-switch 74. The motor 35 will, thereby, be deactivated. The high gear ratio of the gears 36, 38 will maintain the panels 10 in their elevated positions with the emergency lighting system retracted.

As will be able to be seen, therfore, in view of this disclosure, as the crank arm 22 is rotated in a direction to retract the emergency lighting system, the contact 68 of the micro-switch 70 in the second subcircuit 50 will be disengaged by the tab 66 to allow the micro-switch 70 to close. Closure of the micro-switch 70 will render the second subcircuit 50 able to be completed by the relay 60 throwing the poles 62 thereof to the alternate positions, should power to the primary lighting system again be lost.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. An emergency lighting fixture for actuation when power to a primary lighting system in a room is lost, comprising:

(a) a panel mounted in a ceiling of the room for movement between a normal, retracted position, and an extended position, said panel having a first edge defining an axis with respect to which said panel is disposed for pivoting, and wherein, when said panel is in said retracted position, said panel is flush with the ceiling, and wherein, when said panel is in said extended position, said panel is pivoted downwardly about said axis, and wherein said panel has a second edge opposite said first edge and a platen intersecting said panel generally perpendicularly along said second edge, said platen having a generally horizontally extending slot formed therein;

(b) means, when power to the primary lighting system is uninterrupted, for maintaining said panel in said retracted position, and, when power to the primary lighting system becomes interrupted, for moving said panel to said extended position, said means for maintaining and moving comprising;

(i) a shaft having a main portion defining an axis of elongation, and a distal portion, spaced radially from said axis of elongation, said shaft being disposed for movement wherein said main portion thereof rotates about said axis of elongation between a first position, wherein said distal portion is angled away from a directly downwardly extending orientation, and a second position, wherein said distal portion is rotated downwardly from said first position, said distal portion being received in said slot formed in said platen; and (ii) means for orienting said main portion of said shaft in said first position thereof when power to the primary lighting system is uninterrupted, and for rotating said main portion of said shaft to said second position thereof when power to the primary lighting system becomes interrupted;

(c) a lamp mounted on said panel, said lamp projecting generally perpendicularly to said platen; and (d) means, when said panel is in said extended position, for energizing said lamp.

2. A ceiling-mounted emergency lighting system for use when normal electric power is interrupted, comprising:

(a) a battery-powered lamp;

(b) means for retaining said battery-powered lamp recessed within a ceiling in which the system is mounted while normal electric power continues; and (c) means for automatically lowering said battery-powered lamp during an interruption in normal electric power;

(d) wherein said retaining means and said automatically lowering means include a motor drive assembly, said motor drive assembly comprising:

(i) a bi-directional electric motor;

(ii) an arrangement of meshable gears driven by said electric motor;

(iii) a crank arm mounting one of said gears and being rotatable by said motor as said arrangement of gears is driven; and (iv) means for causing said electric motor to be actuated in one direction, in response to a power interruption, to effect lowering of said battery powered lamp.

3. A ceiling-mounted emergency lighting system for use when normal electric current flow powering a primary lighting system is interrupted, comprising:

(a) a battery and a lamp powered thereby;

(b) means for retaining said battery-powered lamp recessed within a ceiling in which the system is mounted in a first position while normal electric current flow continues;

(c) means for automatically moving said battery-powered lamp to a second position extended below said ceiling during an interruption of normal electric current flow; and (d) means for returning said battery-powered lamp to said first position when normal electric current flow resumes;

(e) wherein said retaining means, said moving means, and said returning means include a motor drive assembly, said motor drive assembly comprising an arrangement of a bi-directional motor and high gear ratio gears.

4. The apparatus of claim 3 wherein current flow from said battery powers said moving means and normal electric current flow powers said returning means.

5. The apparatus of claim 3 further comprising switches to stop said motor drive assembly once said battery-powered lamp reaches its first and second positions, respectively.

* * * * *